US005868115A

United States Patent [19]

Fukui

[11] Patent Number: 5,868,115

[45] Date of Patent: Feb. 9, 1999

[54] IGNITION CONTROLLER FOR INTERNAL COMBUSTION ENGINE

[75] Inventor: Wataru Fukui, Tokyo, Japan

[73] Assignee: Mitsubishi Denki Kabushiki Kaisha, Tokyo, Japan

[21] Appl. No.: 889,450

[22] Filed: Jul. 8, 1997

[30] Foreign Application Priority Data

Feb. 3, 1997 [JP] Japan ..... 9-020417

[51] Int. Cl.[6] ..... F02P 5/06

[52] U.S. Cl. ..... 123/406.55

[58] Field of Search ..... 123/417, 418, 123/637, 639, 419, 421, 424

[56] References Cited

U.S. PATENT DOCUMENTS

| | | | |
|---|---|---|---|
| 4,112,890 | 9/1978 | Manger et al. | 123/418 |
| 4,517,952 | 5/1985 | Hosoya | 123/638 |
| 4,796,208 | 1/1989 | Kumagai | 123/418 |
| 4,903,676 | 2/1990 | Gillbrand et al. | 123/637 |
| 4,947,810 | 8/1990 | Gillbrand et al. | 123/637 |
| 5,085,192 | 2/1992 | McDougal et al. | 123/418 |
| 5,724,938 | 3/1998 | Yamada | 123/637 |

FOREIGN PATENT DOCUMENTS 58-174160 10/1983 Japan .

*Primary Examiner*—Thomas N. Moulis

*Attorney, Agent, or Firm*—Sughrue, Mion, Zinn, Macpeak & Seas, PLLC

[57] ABSTRACT

An ignition controller for an internal combustion engine includes a control/calculation circuit for creating drive signals to injectors and ignition coils based on the rotation angle SGT and the operating state of the internal combustion engine. The control/calculation circuit includes means for calculating the respective timings at which the injectors and the ignition coils are controlled according to an operating state, means for discriminating a predetermined operating state corresponding to a state where fuel adheres to the ignition plugs and means for switching the timings at which the ignition plugs are driven according to a signal which discriminates the predetermined operating state. When the predetermined operating state is not discriminated, the timings at which the ignition coils are driven are set to the vicinity of the upper dead point of a compression stroke and when the predetermined operating state is discriminated, the above timings are set to the respective vicinities of the upper dead point of the compression stroke and the upper dead point of an exhaust stroke. With this arrangement, the ignition controller for the internal combustion engine can always maintain a stable combustion state by avoiding the adhesion of fuel to the ignition plugs.

11 Claims, 7 Drawing Sheets

| POSITION OF SGT | B5° | B75° | CORRESPONDING CYLINDER |
|---|---|---|---|
| LEVEL OF SGC | 1 | 1 | #1 |
| | 1 | 0 | #3 |
| | 0 | 1 | #4 |
| | 0 | 0 | #2 |

IGNITION CONTROLLER FOR INTERNAL COMBUSTION ENGINE

BACKGROUND OF THE INVENTION

1. Field of the Invention

The present invention relates to an ignition controller for a four-cycle internal combustion engine, and more specifically, to an ignition controller for an internal combustion engine capable of securing a stable combustion by avoiding the fuel adhesion state to the ignition plugs.

2. Description of the Related Art

FIG. 7 is a view of the arrangement showing an ignition controller for a conventional internal combustion engine.

In the drawing, an angle sensor 10 disposed to the crank shaft or the cam shaft (not shown) of the internal combustion engine detects the rotational angle of the internal combustion engine and outputs a crank angle signal SGT showing the reference crank angle of each of cylinders and a cylinder identification signal SGC for identifying each of the cylinders.

Usually, a crank angle sensor (not shown) of the angle sensor 10 for creating the crank angle signal SGT is disposed to a crank shaft and a cylinder identification sensor (not shown) thereof for creating the cylinder identification signal SGC is disposed to a cam shaft.

Various sensors 12 for detecting the operating state of the internal combustion engine include a load sensor 14 for detecting a load Q corresponding to an amount of air sucked by the internal combustion engine.

Further, the various sensors 12 include, for example, a water temperature sensor which detects a cooling water temperature TW as another operating state.

Injectors 16 disposed in correspondence with the respective cylinders of the internal combustion engine inject a predetermined amount of fuel by driving the fuel injection valves of the respective cylinders at predetermined timings.

Each of ignition coils 18 disposed in correspondence with the respective cylinders of the internal combustion engine includes a primary winding 18*a* and a secondary winding 18*b* constituting a transformer and imposes an ignition high voltage to the ignition plug 20 of each of the respective cylinders from the secondary winding 18*b*.

A power transistor 22 connected to the primary winding 18*a* of each of the ignition coils 18 shuts off a primary current il flowing to the primary winding 18*a* and generates an increased high voltage from the secondary winding 18*b*.

An electronic control unit 30 (hereinafter, referred to as an ECU) composed of a microcomputer includes an input interface 32 for fetching the crank angle signal SGT, the cylinder identification signal SGC, the load Q, the cooling water temperature TW and the like, a control/calculation circuit 34 for creating drive signals J and P to the injectors 16 and the ignition coils 18 based on various types of information input through the input interface 32 and an output interface 36 for outputting the respective drive signals J and P.

The control/calculation circuit 34 calculates the respective control timings of the injectors 16 and the ignition coils 18 based on the operating state of the internal combustion engine and outputs the drive signals J and P according to the respective control timings.

The drive signal P to the ignition coils 18 acts as a base current of the power transistors 22 and intermittently turns on the power transistors 22 in the sequence of #1 cylinder→#3 cylinder→#4 cylinder→#2 cylinder and sequentially shuts off the primary current i1 supplied to the respective ignition coils 18.

Next, operation of the ignition controller for the conventional internal combustion engine shown in FIG. 7 will be described with reference to the timing chart of FIG. 8.

In FIG. 8, the crank angle signal SGT is composed of a pulse signal according to the rotation of the crank shaft and the rising edges of respective pulses show a first reference position (reference crank angle) B75° (crank angle 75° this side from TDC) corresponding to the respective cylinders (#1–#4) and the falling edges thereof show a second reference position B5° (crank angle 5° this side from TDC).

The cylinder identification signal SGC is composed of a pulse signal offset in correspondence with particular cylinders (for example, #1 and #4 cylinders) and generates a level (H level or L level) at the respective edges (first and second reference positions) of the crank angle signal SGT in a predetermined sequence to thereby specify the respective cylinders (#1–#4 cylinders).

In the case of FIG. 8, the level of the cylinder identification signal SGC at the first reference position B75° is changed by the rotation of the internal combustion engine such that the H level and the L level are alternately repeated, so that a group of the cylinder which are ignited simultaneously (group ignition) can be identified.

Further, the level of the cylinder identification signal SGC at the second reference position B5° is set to the H level only to a particular cylinder (for example, #1 cylinder), so that the specific cylinder can be identified.

Note, various patterns are observed in the cylinder identification signal SGC and crank angle signal SGT, for example, as shown in FIG. 9. The respective cylinders can be immediately identified from the levels of the cylinder identification signal SGC at a pair of the edges B5° and B75° of the respective pulses of the crank angle signal SGT.

That is, as shown in FIG. 10, when the levels of the cylinder identification signal SGC at the respective reference positions B5° and B75° are "1, 1", "the #1 cylinder" is specified, when the levels are "1, 0", "the #3 cylinder" is specified, when the levels are "0, 1", "the #4 cylinder" is specified and when the levels are "0, 0", "the #2 cylinder" is specified as a corresponding cylinder, respectively.

When the respective cylinders are identified, the control/calculation circuit 34 detects the operating state of the internal combustion engine based on the crank angle signal SGT and the cylinder identification signal SGC from the angle sensor 10, the load Q from the load sensor 14 and other signals detected by the various sensors 12. The circuit also calculates the control parameters (timing at which fuel is injected, ignition timing and the like) of each cylinder using the respective reference positions B75° and B5° as control references.

Therefore, the drive signal J to the injectors 16 and the drive signal P to the power transistors 22 (ignition coils 18) are sequentially created in correspondence to the respective cylinders at an optimum timing corresponding to the operating state of the internal combustion engine.

The power transistors 22 are sequentially turned on by the drive signal P and the primary current i1 supplied to the respective ignition coils 18 are shut off in the sequence of #1 cylinder→#3 cylinder→#4 cylinder→#2 cylinder as shown in FIG. 8.

With this operation, the ignition of the ignition plugs 20 of the respective cylinders is controlled in such a manner that the ignition plugs 20 are sequentially discharged. Usually, the timing at which the primary current i1 is shut off (ignition timing) is set to the vicinity of the second reference position B5°, that is, in the vicinity of the upper dead point in a compression stroke.

As described above, the control/calculation circuit 34 controls the injectors 16 and the ignition coils 18 of the respective cylinders at the optimum timing according to the operating state.

However, when the ignition plugs 20 are cooled at the start of the internal combustion engine or when fuel adheres to the ignition plugs 20 in the operating state in which a lot of fuel is injected (so-called, a sooting state), a normal combustible environment cannot be created and combustion is made unstable.

Since no countermeasure is taken in the fuel adhesion state (sooting) for the ignition plugs 20 by the ignition controller for the conventional internal combustion engine as described above, there is a problem that when fuel adheres to the ignition plugs 20, a combustion state is made unstable, by which an exhaust (emission) is deteriorated and rotation is varied.

An object of the present invention is to solve the above problem by providing an ignition controller for an internal combustion engine capable of maintaining a stable combustion state at all times by avoiding the adhesion of fuel to ignition plugs.

SUMMARY OF THE INVENTION

An ignition controller for an internal combustion engine according to the present invention comprises an angle sensor for detecting the rotational angle of the internal combustion engine; various sensors for detecting the operating state including the load of the internal combustion engine; injectors for injecting fuel to respective cylinders of the internal combustion engine; ignition coils for imposing a high voltage to ignition plugs of the respective cylinders of the internal combustion engine; and a control/calculation circuit for creating drive signals to the injectors and the ignition coils based on the rotational angle and the operating state, wherein the control/calculation circuit includes timing calculation means for calculating the respective timings of the injectors and the ignition coils according to the operating state; predetermined operating state discriminating means for discriminating a predetermined operating state corresponding to the fuel adhesion state of the ignition plugs; and ignition timing switch means for switching the timings at which the ignition coils are driven according to the predetermined operating state, wherein when the predetermined operating state is not discriminated, the timings at which the ignition coils are driven are set to the vicinity of the upper dead point of a compression stroke and when the predetermined operating state is discriminated, the timings at which the ignition coils are driven are set to the respective vicinities of the upper dead point of the compression stroke and the upper dead point of an exhaust stroke.

The predetermined operating state discrimination means of an ignition controller for an internal combustion engine according to the present invention includes a rotation variable amount calculation means for calculating the rotation variable amount of the internal combustion engine, and the predetermined operating state discrimination means discriminates the predetermined operating state when the rotation variable amount shows a value equal to or greater than a predetermined value.

The various sensors of an ignition controller for an internal combustion engine according to the present invention include a water temperature sensor for detecting the cooling water temperature of the internal combustion engine and the predetermined operating state discrimination means discriminates the predetermined operating state when the cooling water temperature shows a value equal to or less than a predetermined value.

The predetermined operating state discrimination means of an ignition controller for an internal combustion engine according to the present invention includes fuel injection finish time calculation means for calculating a fuel injection finish time based on the drive signal of the injectors, and the predetermined operating state discrimination means discriminates the predetermined operating state when the fuel injection finish time shows a time on or after the time for a predetermined crank angle.

The predetermined operating state discrimination means of an ignition controller for an internal combustion engine according to the present invention includes an amount of injected fuel calculation means for calculating an amount of injected fuel based on the drive signal of the injectors, and the predetermined operating state discrimination means discriminates the predetermined operating state when the amount of injected fuel shows a value equal to or greater than a predetermined value, the amount of injected fuel calculation means discriminates the predetermined operating state.

DESCRIPTION OF THE PREFERRED EMBODIMENTS

Embodiment 1

Figure 1:
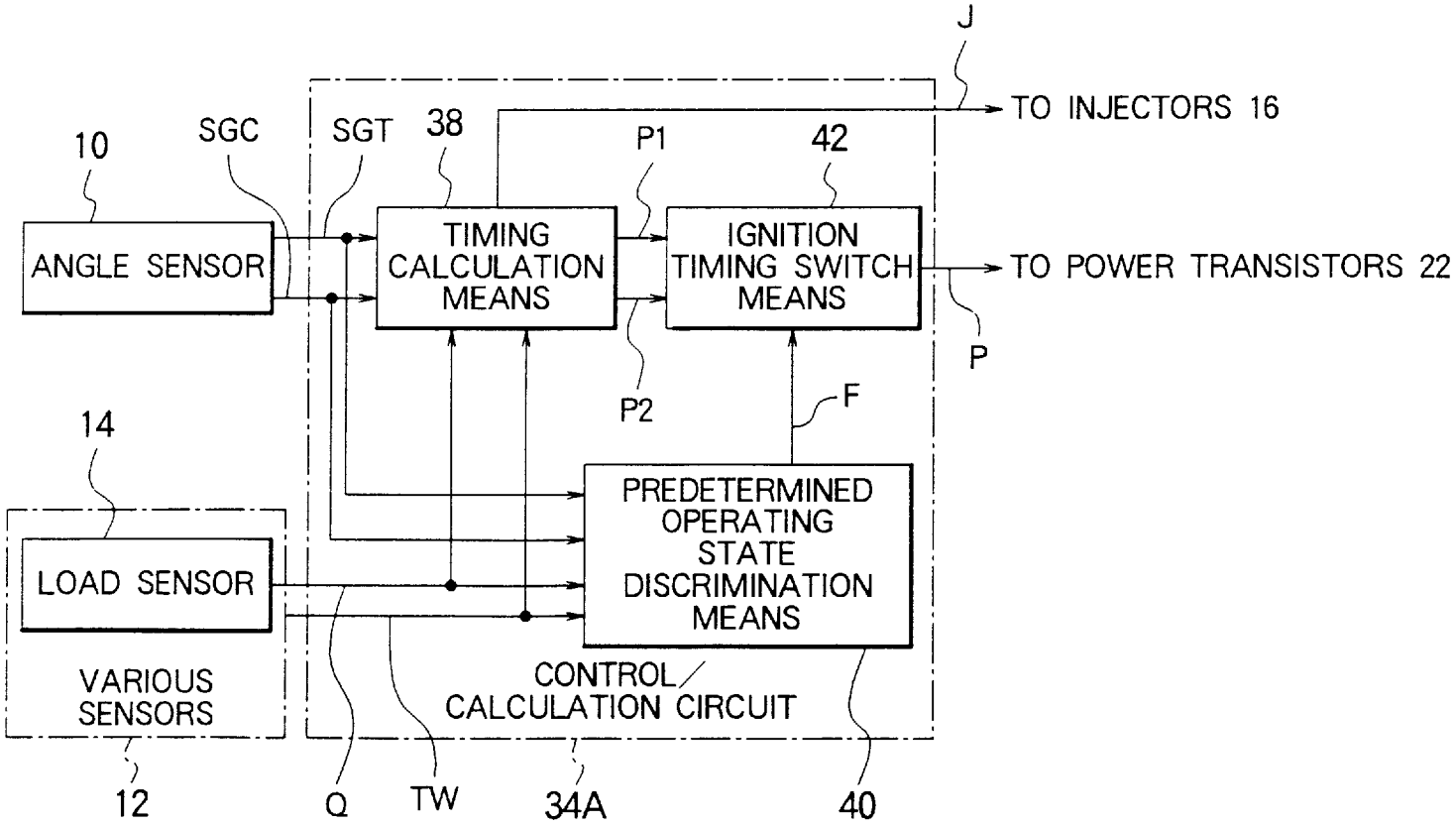
FIG. 1 is a block diagram showing the main portion of an embodiment 1 of the present invention.

An embodiment 1 of the present invention will be described with reference to the drawings. FIG. 1 is a block diagram showing the main portion of the embodiment 1 of the present invention, wherein an angle sensor 10, various sensors 12, a load sensor 14, injectors 16 and power transistors 22 are similar to those described above.

Figure 7:
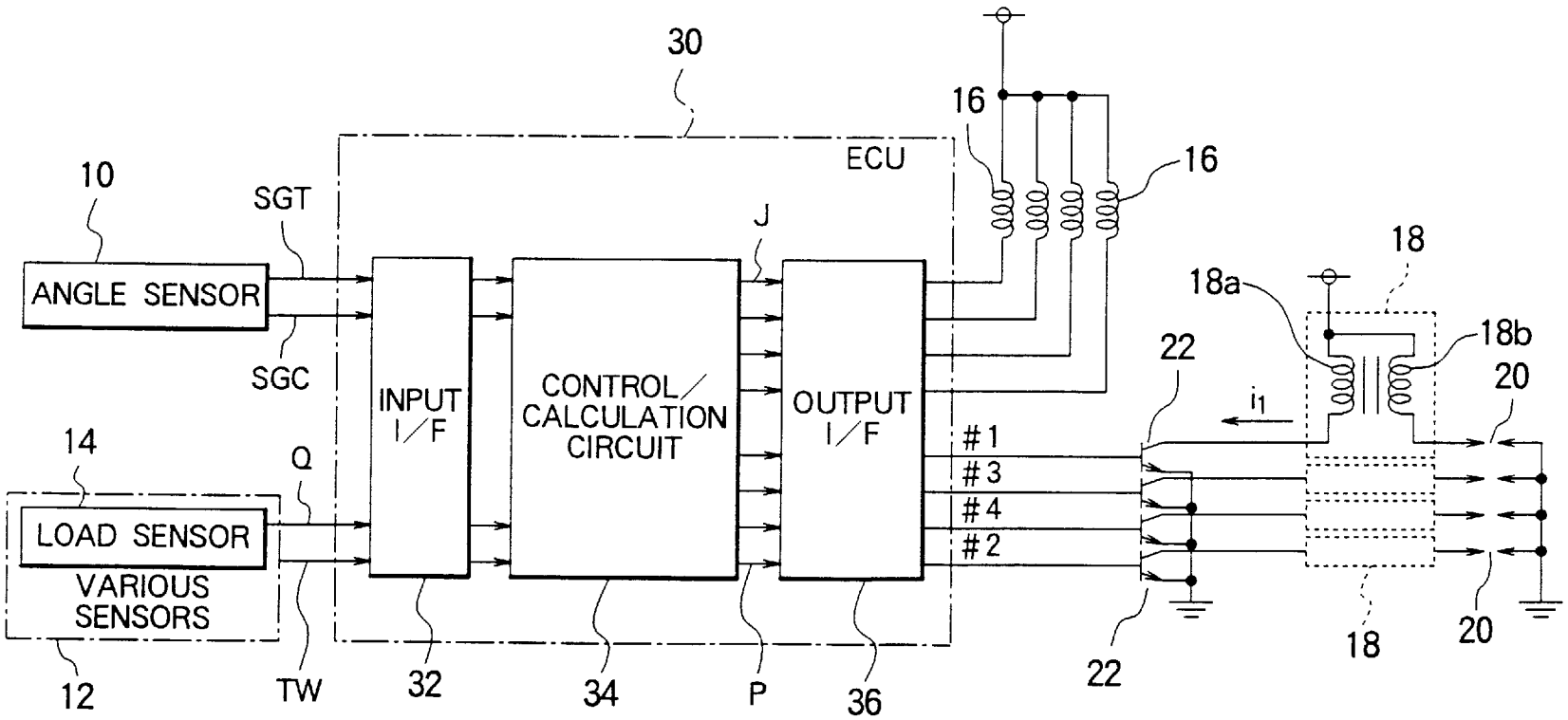
FIG. 7 PRIOR ART
FIG. 7 is a view showing the arrangement of an ignition controller for an ordinary internal combustion engine.
Figure 8:
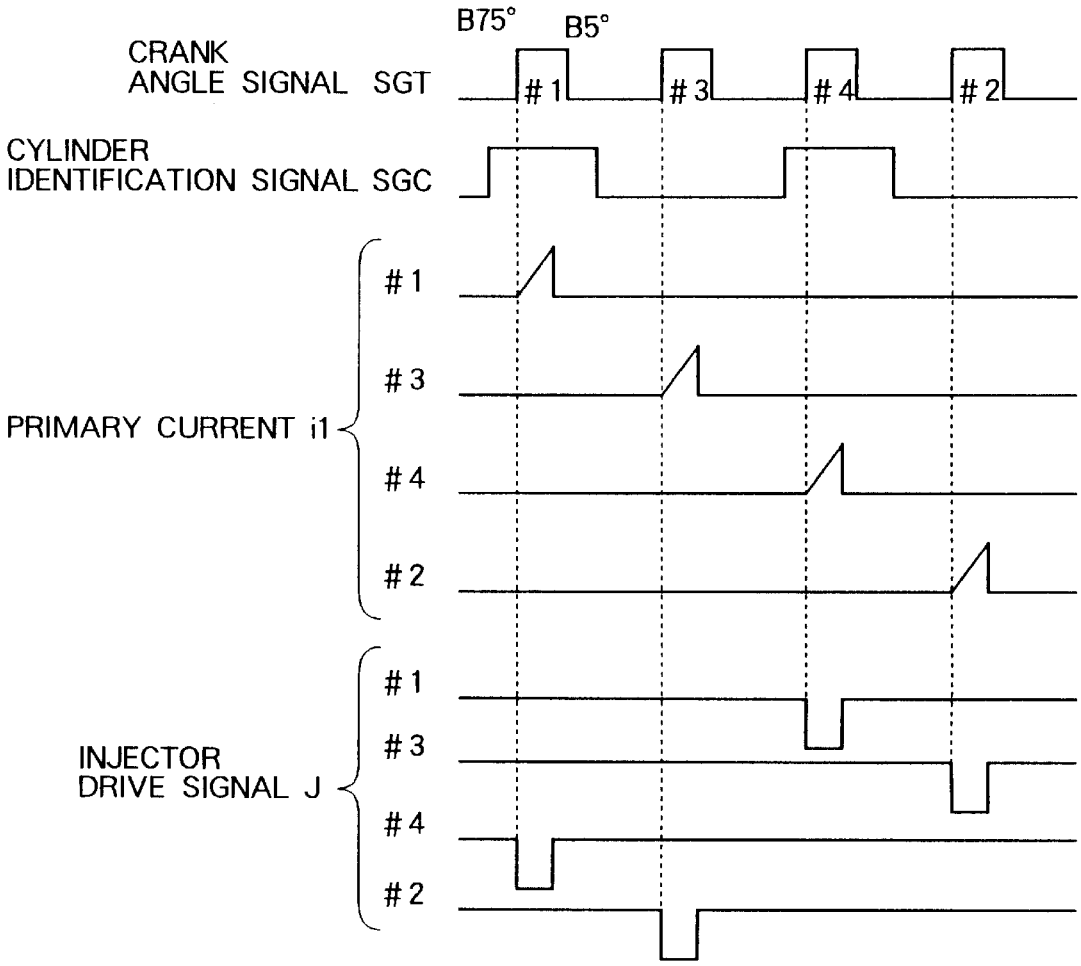
FIG. 8 PRIOR ART
FIG. 8 is a timing chart explaining operation of an ignition controller for a conventional internal combustion engine.

The arrangement not shown in FIG. 1 is as shown in FIG. 7 and an ECU 30, an input interface 32 and an output interface 36 are omitted in FIG. 1.

In this case, a control/calculation circuit 34A includes a timing calculation means 38 for calculating control parameters according to an operation state, a predetermined operating state discrimination means 40 for discriminating a predetermined operating state which corresponds the sooting state of ignition plugs 20 (see FIG. 7) and an ignition timing switch means 42 for switching ignition control in response to the predetermined operating state.

The timing calculation means 38 calculates respective control timings for the injectors 16 and the ignition plugs 20 according to the operating state based on respective sensor signals SGT, SGC, Q, and TW and creates an injector drive signal J as well as a first ignition drive signal P1 and a second ignition drive signal P2 according to the respective control timings.

The predetermined operating state discrimination means 40 discriminates the predetermined operating state corresponding to the fuel adhesion state based on the respective sensor signals SGT, SGC, Q and TW and outputs a discrimination signal F when the predetermined operating state is discriminated.

For example, the predetermined operating state discrimination means 40 includes rotation variable amount calculation means for calculating a rotation variable amount $\alpha$ based on the pulse cycle of the crank angle signal SGT and discriminates the predetermined operating state when the rotation variable amount $\alpha$ shows a value equal to or greater than a predetermined value $\alpha_0$.

The ignition timing switch means 42 switches the timings at which the ignition coils 18 are driven according to a discriminating signal F showing the predetermined operating state and outputs the second ignition drive signal P2 as a final drive signal P.

That is, the ignition timing switch means 42 outputs the first ignition drive signal P1 corresponding to a normal combustion as the final drive signal P in the ordinary operating state. In this case the discrimination signal F is not created. The timing switch sets the timings at which the ignition coils 18 are driven to the vicinity of the upper dead point of a compression stroke.

The ignition timing switch means 42 outputs the second ignition drive signal P2 as the final dive signal P in the predetermined operating state in which the discrimination signal F is created. In this case, the timing switch sets the timings at which the ignition coils 18 are driven as two instances. These instances correspond to the vicinity of the upper dead point of the compression stroke and the upper vicinity of the dead point of an exhaust stroke. The ignition timing is set twice.

Next, operation of the embodiment 1 of the present invention shown in FIG. 1 will be described with reference to the timing chart of FIG. 2 and the flowchart of FIG. 3.

Figures 9, 10:
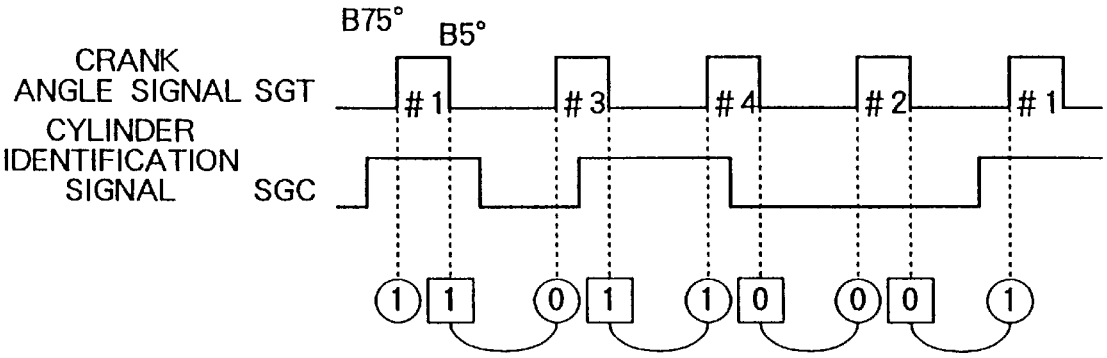
FIG. 9 PRIOR ART
FIG. 10 PRIOR ART
FIG. 9 is a timing chart explaining another example of an ordinary cylinder identification signal.
FIG. 10 is a view explaining a cylinder identification pattern formed by a cylinder identification signal in FIG. 9.

In this case, a pulse pattern shown in FIG. 9 is applied as the cylinder identification signal SGC (see FIG. 2) and the predetermined operating state discrimination means 40 discriminates the predetermined operating state based on the rotation variable amount $\alpha$.

Figure 3:
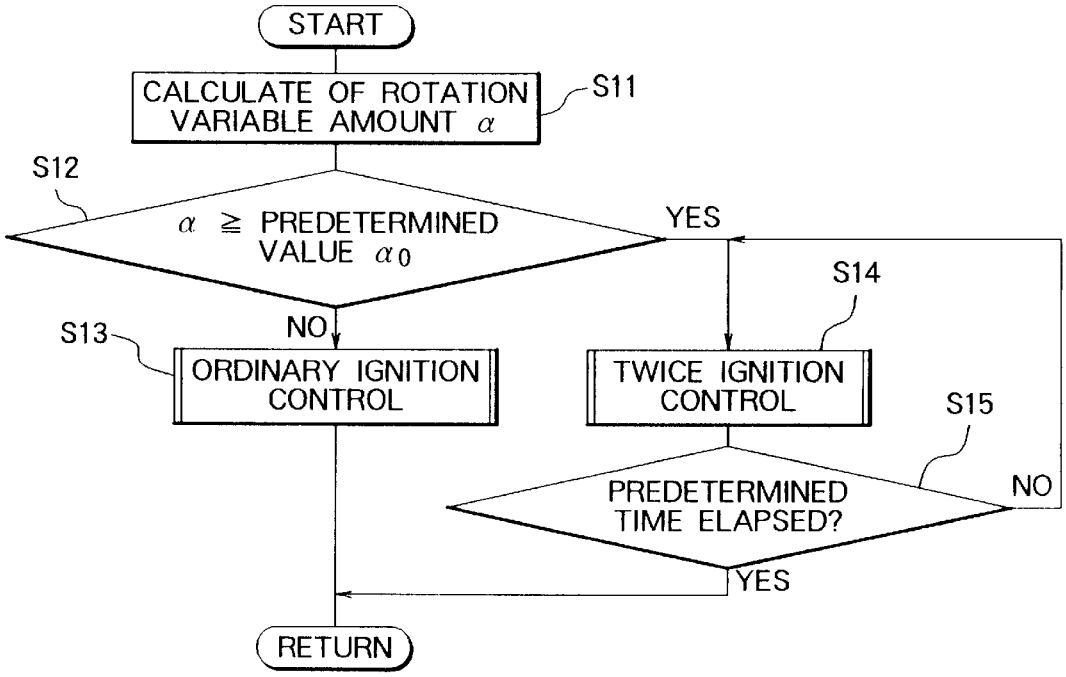
FIG. 3 is a flowchart showing operation for discriminating a predetermined operating state executed by the embodiment 1 of the present invention.

In FIG. 3, first, the predetermined operating state discrimination means 40 calculates the rotation variable amount $\alpha$ from the cyclic variation of the crank angle signal SGT (step S11) and determines whether the rotation variable amount $\alpha$ is equal to or greater than the predetermined value $\alpha_0$ by comparing the rotation variable amount $\alpha$ with the predetermined value $\alpha_0$ (step S12).

If it is determined that $\alpha<\alpha_0$ (that is, NO), the predetermined operating state discrimination means 40 regards a present operating state as the ordinary operating state in which rotation is stabilized and does not create a determination signal F.

Therefore, the ignition timing switch means 42 outputs the ordinary drive signal P1 to the power transistors 22.

With this operation, the timings at which the ignition coils 18 are driven, that is, the timings at which the primary current i1 is shut off are set only to the vicinity of the upper dead point of the compression stroke (the vicinity of the second reference position B5°) and ordinary ignition control is executed (step S13).

On the other hand, if it is determined that $\alpha\geqq\alpha_0$ (that is, YES) at step S12, the predetermined operating state discrimination means 40 regards the present operating state as the predetermined operating state and creates the determination signal F.

Therefore, the ignition timing switch means 42 outputs the second ignition drive signal P2 to the power transistors 22, by which the timings at which the ignition coils 18 are driven are set to both the respective vicinities of the upper dead point of the compression stroke and the upper dead point of the exhaust stroke, so that twice ignition control is executed (step S14).

Figure 2:
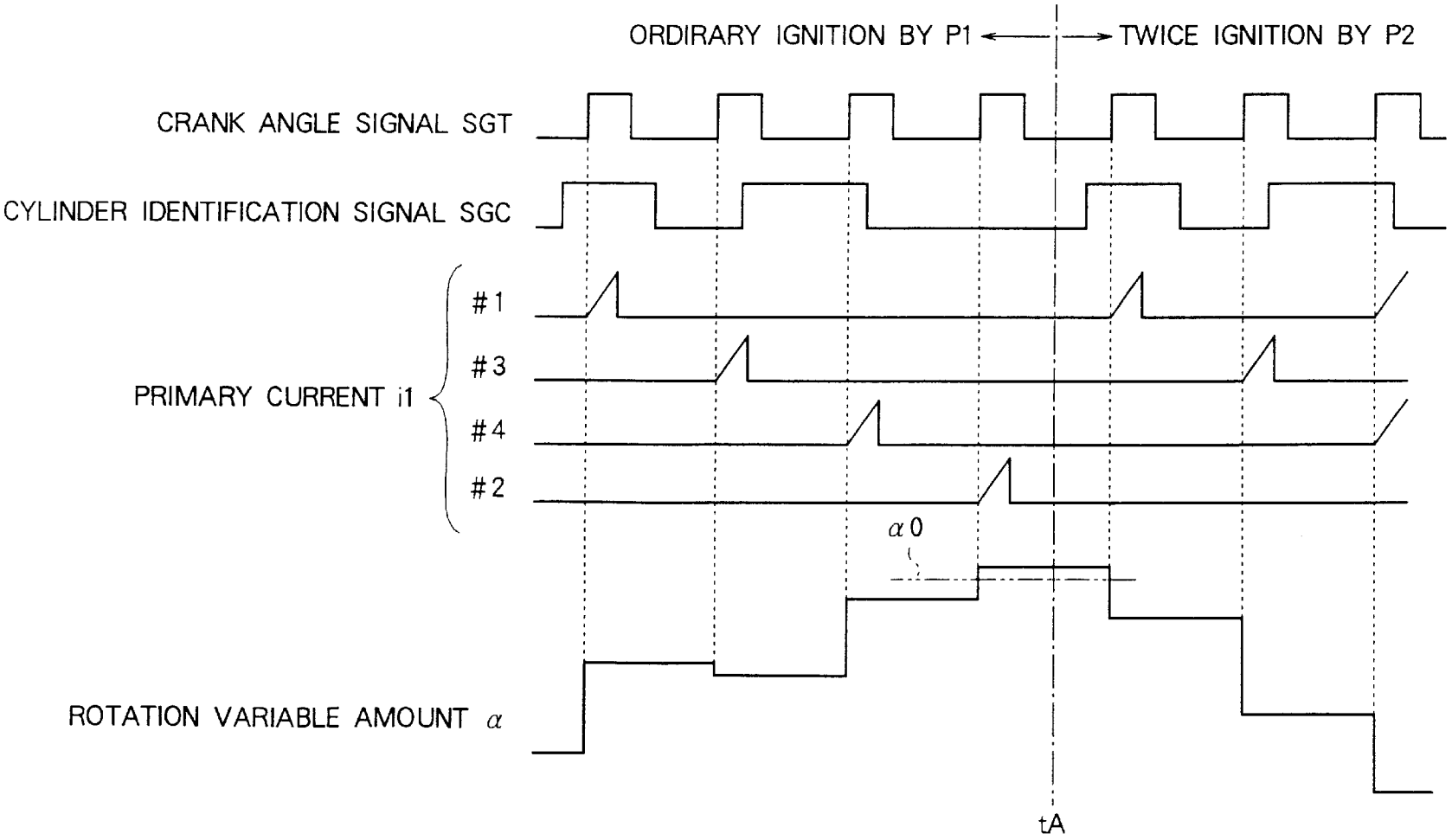
FIG. 2 is a timing chart explaining operation of the embodiment 1 of the present invention.

FIG. 2 shows a state where the ordinary ignition control is switched to the twice ignition control from the time tA at which the rotation variable amount $\alpha$ is made equal to or greater than the predetermined value $\alpha_0$.

Subsequently, the ignition timing switch means 42 determines whether the twice ignition control step S14 has continued for a predetermined period of time sufficient to remove the predetermined operating state (sooting state) or not (step S15) and if it is determined that the predetermined period of time has not elapsed (that is, NO), the process returns to step S14 and repeats the twice ignition control.

Further, if it is determined that the predetermined period of time has elapsed (that is, YES), the process returns to initial step S11 of FIG. 3, confirms that the rotation variable amount $\alpha$ is made smaller than $\alpha_0$ (step S12) and then returns the ignition control to the ordinary ignition state (step S13).

As described above, when it is detected that the rotation variable amount $\alpha$ is increased and the operating state of the internal combustion engine is deteriorated, it is regarded that fuel has adhered to the ignition plugs 20 (predetermined operating state occurs) and ignition frequency is increased by adding the ignition control in the vicinity of exhaust TDC in addition to the ignition control in the vicinity of intrinsic compression TDC. As a result, "the sooting state" is promptly solved by burning out the carbon adhering to the ignition plugs 20, so that a stable operating state can be maintained by excellent combustion.

Embodiment 2

Note, the embodiment 1 discriminates the predetermined operating state at the time the deterioration of combustion state caused by the adhesion of fuel to the ignition plugs 20 (sooting) is detected and switches the ignition control to the twice ignition control. However, the predetermined operating state may also be detected when the deterioration of the combustion state due to sooting is predicted and the ignition control may be switched to the twice ignition control.

Figure 4:
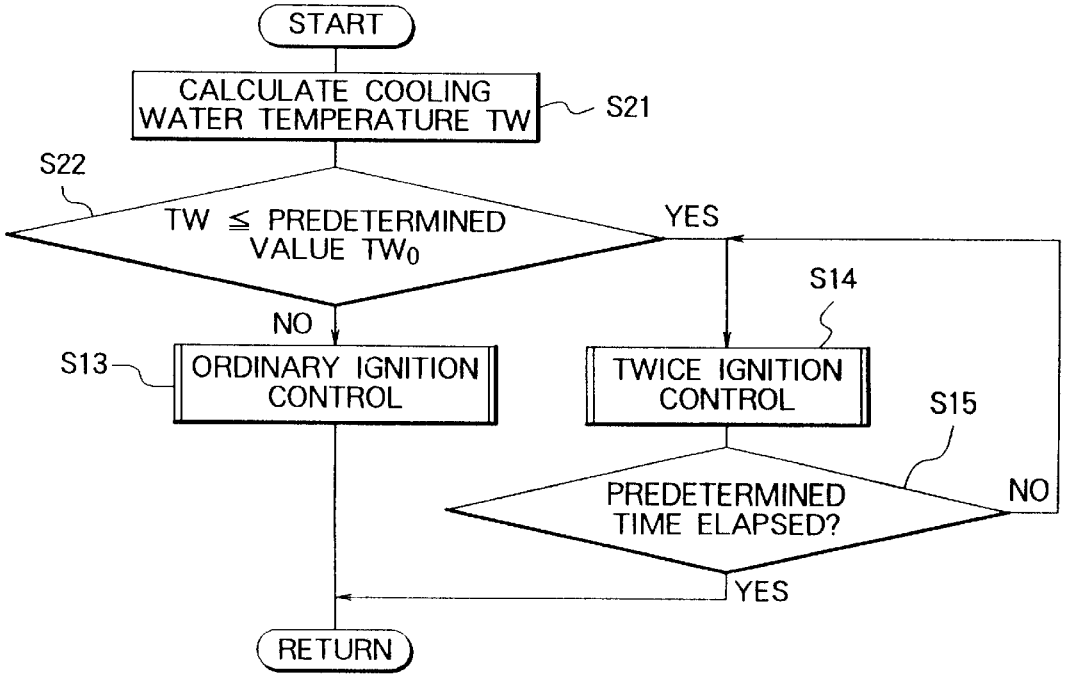
FIG. 4 is a flowchart showing operation for discriminating a predetermined operating state executed by an embodiment 2 of the present invention.

FIG. 4 is a flowchart showing predetermined operating state discriminating operation executed by an embodiment 2 of the present invention in which the predetermined operating state is discriminated by a cooling state at engine start up. Respective steps S13–S15 in FIG. 4 are the same as those in FIG. 3.

A control/calculation circuit 34A is arranged similarly to that shown FIG. 1 and only the function of a predetermined operating state discrimination means 40 is different from that described above.

In this case, various sensors 12 includes a water temperature sensor that output a cooling water temperature TW as information showing an operating state.

In FIG. 4, first, the predetermined operating state discrimination means 40 determines whether the cooling water temperature TW is equal to or less than a predetermined value $TW_0$ by referring to or calculating the cooling water temperature TW (step S21) and comparing the cooling water temperature TW with the predetermined value $TW_0$ (step S22).

If it is determined that $TW>TW_0$ (that is NO), the predetermined operating state discrimination means 40 regards a present operating state as a sufficiently warmed ordinary operating state and does not create the discrimination signal F.

Therefore, an ignition timing switch means 42 outputs the ordinary ignition drive signal P1 to power transistors 22 and executes the ordinary ignition control (step S13).

On the other hand, if it is determined at step S22 that $TW \leqq TW_0$ (that is, YES), the predetermined operating state discrimination means 40 regards the present operating state as a cooled state at start up. In other words the predetermined operating state is detected, as adhesion of fuel to the ignition plug 20 is predicted, and creates the discrimination signal F.

Therefore, the ignition timing switch means 42 outputs the second ignition drive signal P2 to the power transistors 22 and executes the twice ignition control (step S14).

As described above, the ignition control in the vicinity of exhaust TDC is added in addition to the ignition control in the vicinity of intrinsic compression TDC in the predetermined operating state (at start). In this case, it is predicted that a combustion state is deteriorated by the adhesion of fuel to the ignition plugs 20 based on the signal (cooling water temperature TW) detected by the various sensors 12 showing the operating state of an internal combustion engine.

With this operation, discharge sparks are made to be easily generated by increasing the temperature of the ignition plugs 20 in a short time from the cooled state at engine start up. It is also made difficult for fuel to adhere to the ignition plugs 20 to thereby prevent "the sooting state".

Embodiment 3

Note, although the cooled state is discriminated as the predetermined operating state in which deterioration of combustion is predicted in the embodiment 2, the predetermined operating state may also be discriminated when fuel is injected for a long time (when fuel injection is finished after a predetermined time).

Figure 5:
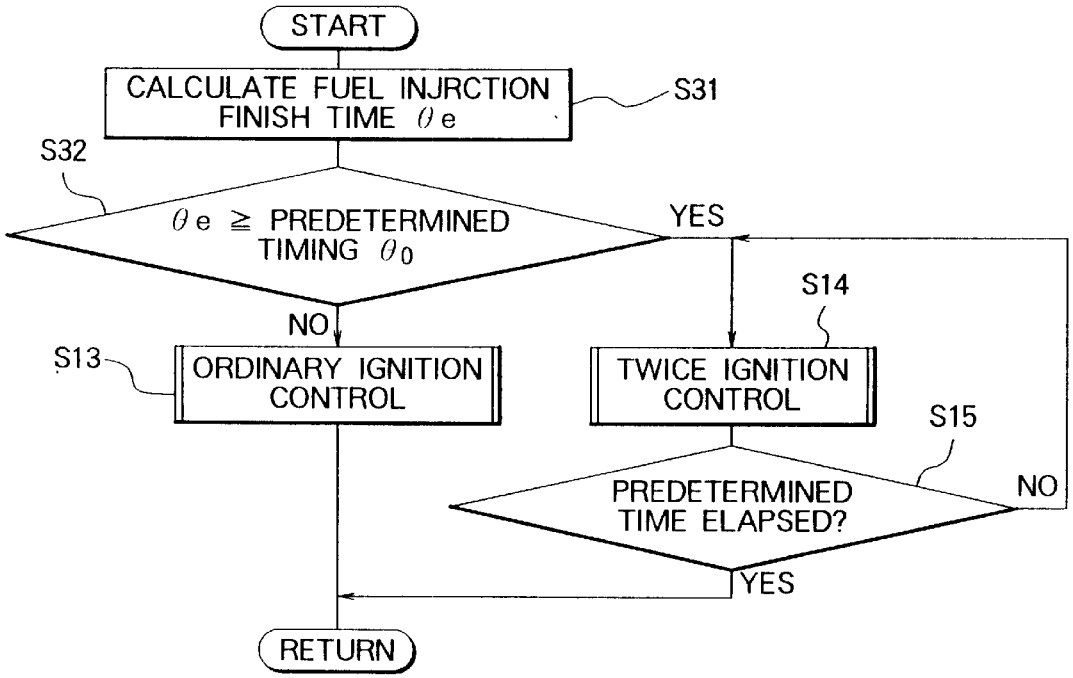
FIG. 5 is a flowchart showing operation for discriminating a predetermined operating state executed by an embodiment 3 of the present invention.

FIG. 5 is a flowchart showing predetermined operating state discriminating operation executed by an embodiment 3 of the present invention in which the predetermined operating state is discriminated by a fuel injection time. In FIG. 5, respective steps S13–S15 are the same as those in FIG. 3.

In this case, predetermined operating state discrimination means 40 (see FIG. 1) fetches the drive signal J of injectors 16, and includes a fuel injection finish time calculation means for calculating a fuel injection finish time $\theta_e$ based on the drive signal J. The discrimination means outputs the discrimination signal F by discriminating the predetermined operating state when the fuel injection finish time $\theta_e$ shows a time on which is after a predetermine time (corresponding to a predetermined crank angle) $\theta_0$.

In FIG. 5, first, the predetermined operating state discrimination means 40 calculates the fuel injection finish time $\theta_e$ (step S31) from the drive signal J (step S31) and determines whether the fuel injection finish time $\theta_e$ is on after the time for the predetermined crank angle $\theta_0$ or not by comparing the fuel injection finish time $\theta_e$ with the time for the predetermined crank angle $\theta_0$ (step S32).

If it is determined that $\theta_e<\theta_0$ (that is, NO), since the predetermined operating state discrimination means 40 regards a present operating state as the ordinary operating state in which an amount of fuel injection is not increased and does not create the discrimination signal F, the ignition timing switch means 42 executes the ordinary ignition control by outputting the ordinary ignition drive signal P1 (step S13).

On the other hand, if it is determined that $\theta_e \geqq_0$ (that is, YES) at step S32, the predetermined operating state discrimination means 40 regards the present operating state as the predetermined operating state, where injecting fuel is increased (it is predicted that the fuel is adhered to ignition plugs 20) and creates the discrimination signal F. Therefore, the ignition timing switch means 42 executes the twice ignition control by outputting the second ignition drive signal P2 (step S14).

As described above, the ignition control in the vicinity of exhaust TDC is added in addition to the ignition control in the vicinity of intrinsic compression TDC in the predetermined operating state (when the amount of injecting fuel is increased) in which it is predicted that a combustion state is deteriorated by the adhesion of fuel to the ignition plugs 20. This prediction is based on the signal detected by the various sensors 12 showing the operating state of an internal combustion engine.

With this operation, since it is difficult for fuel to adhere to the ignition plugs 20, "the sooting state" can be prevented.

Further, even if fuel does adhere to the ignition plug, "the sooting state" can be solved by promptly burning out the carbon adhered to the ignition plugs 20.

Embodiment 4

Note, although the amount of injected fuel increased state is discriminated based on the fuel injection finish time in the embodiment 3, it may be discriminated based on an amount of injected fuel $\beta$.

Figure 6:
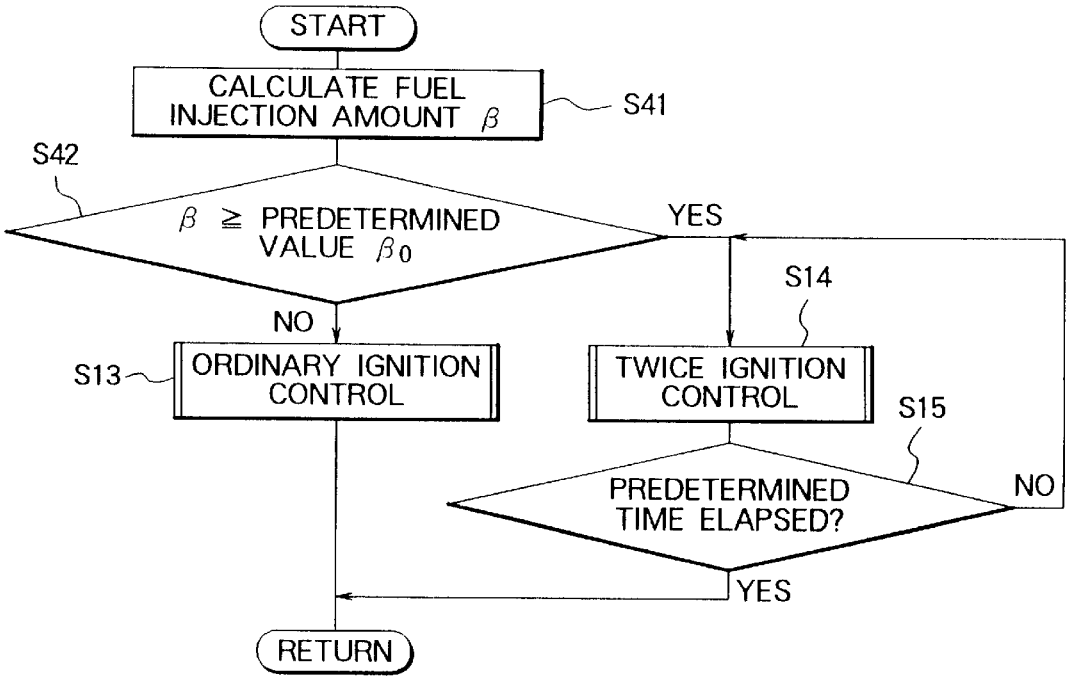
FIG. 6 is a flowchart showing operation for discriminating a predetermined operating state executed by an embodiment 4 of the present invention.

FIG. 6 is a flowchart showing predetermined operating state discriminating operation executed by an embodiment 4 of the present invention for discriminating the predetermined operating state from an amount of injected fuel. Respective steps S13–S15 in FIG. 6 are the same as those shown in FIG. 3.

In this case, predetermined operating state discrimination means 40 (see FIG. 1) fetches the injector drive signal J. The discrimination means includes an amount of injected fuel calculation means for calculating the amount of injected fuel $\beta$ based on the drive signal J and outputs the discrimination signal F by discriminating the predetermined operating state when the amount of injected fuel $\beta$ is equal to or greater than a predetermined value $\beta_0$.

In FIG. 6, first, the predetermined operating state discrimination means 40 calculates the amount of injected fuel $\beta$ from the drive signal J (step S41) and determines whether the amount of injected fuel $\beta$ is equal to or greater than the predetermined value $\beta_0$ by comparing the amount of injected fuel $\beta$ with the predetermined value $\beta_0$ (step S42).

If it is determined $\beta<\beta_0$ (that is, NO), the predetermined operating state discrimination means 40 regards a present operating state as the ordinary operating state in which an amount of injected fuel is not increased and does not create the discrimination signal F. Therefore, ignition timing switch means 42 executes the ordinary ignition control by outputting the ordinary ignition drive signal P1 (step S13).

On the other hand, when it is determined at step S42 that $\beta \geqq \beta_0$ (that is YES), the predetermined operating state discrimination means 40 regards the present operating state as the predetermined operating state in which the amount of injected fuel is increased (adhesion of fuel to the ignition plug 20 is predicted) and outputs the discrimination signal F. Therefore, the ignition timing switch means 42 executes the twice ignition control by outputting the second ignition drive signal P2 (step S14).

As described above, the ignition control in the vicinity of exhaust TDC is added in addition to the ignition control in the vicinity of intrinsic compression TDC in the predetermined operating state (when the amount of injected fuel is increased) in which it is predicted that a combustion state is deteriorated by the adhesion of fuel to the ignition plugs 20. The prediction is based on the signal detected by the various sensors 12 showing the operating state of an internal combustion engine.

With this operation, since it is difficult for fuel to adhere to the ignition plugs 20, "the sooting state" can be prevented.

Further, even if fuel does adhere to the ignition plugs, "the sooting state" can be solved by promptly burning out the carbon adhered to the ignition plugs 20.

What is claimed is:

1. An ignition controller for an internal combustion engine, comprising:

an angle sensor for detecting a rotational angle of the internal combustion engine;

various sensors for detecting an operating state including a load, of the internal combustion engine;

injectors for injecting fuel to respective cylinders of the internal combustion engine;

ignition coils for imposing a high voltage to ignition plugs of the respective cylinders of the internal combustion engine; and a control and calculation circuit for creating drive signals to said injectors and said ignition coils based on the rotational angle and the operating state, wherein said control and calculation circuit includes:

timing calculation means for calculating the respective timings of said injectors and said ignition coils according to the operating state;

predetermined operating state discriminating means for discriminating a predetermined operating state corresponding to a state where fuel adheres to said ignition plugs; and ignition timing switch means for switching the timings at which said ignition coils are driven according to the predetermined operating state, wherein:

when the predetermined operating state is not discriminated, the timings at which the ignition coils are driven are set to the vicinity of the upper dead point of a compression stroke; and when the predetermined operating state is discriminated, the timings at which the ignition coils are driven are set to the respective vicinities of the upper dead point of the compression stroke and the upper dead point of an exhaust stroke.

2. An ignition controller for an internal combustion engine according to claim 1, wherein said predetermined operating state discrimination means includes a rotation variable amount calculation means for calculating the rotation variable amount of the internal combustion engine, and said predetermined operating state discrimination means discriminates the predetermined operating state when the rotation variable amount shows a value equal to or greater than a predetermined value.

3. An ignition controller for an internal combustion engine according to claim 1, wherein said various sensors include a water temperature sensor for detecting the cooling water temperature of the internal combustion engine and said predetermined operating state discrimination means discriminates the predetermined operating state when the cooling water temperature shows a value equal to or less than a predetermined value.

4. An ignition controller for an internal combustion engine according to claim 1, wherein the predetermined operating state discrimination means includes fuel injection finish time calculation means for calculating a fuel injection finish time based on the drive signal of the injectors, and said predetermined operating state discrimination means discriminates the predetermined operating state when the fuel injection finish time shows a time on or after a predetermined crank angle.

5. An ignition controller for an internal combustion engine according to claim 1, wherein said predetermined operating state discrimination means includes amount of injected fuel calculation means for calculating an amount of injected fuel based on the drive signal of said injectors, and said predetermined operating state discrimination means discriminates the predetermined operating state when the amount of injected fuel shows a value equal to or greater than a predetermined value.

6. The ignition controller of claim 1, wherein when the predetermined operating state is discriminated, the timings at which the ignition coils are driven are set only to the vicinity of the upper dead point of the compression stroke and the vicinity of the upper dead point of the exhaust stroke for a respective cylinder.

7. The ignition controller of claim 6, wherein said predetermined operating state discrimination means includes a rotation variable amount calculation means for calculating the rotation variable amount of the internal combustion engine, and said predetermined operating state discrimination means discriminates the predetermined operating state when the rotation variable amount reaches a value equal to or greater than a predetermined value.

8. An ignition controller for an internal combustion engine according to claim 6, wherein said various sensors include a water temperature sensor for detecting the cooling water temperature of the internal combustion engine and said predetermined operating state discrimination means discriminates the predetermined operating state when the cooling water temperature reaches a value equal to or less than a predetermined value.

9. An ignition controller for an internal combustion engine according to claim 6, wherein the predetermined operating state discrimination means includes fuel injection finish time calculation means for calculating a fuel injection finish time based on the drive signal of the injectors, and said predetermined operating state discrimination means discriminates the predetermined operating state when the fuel injection finish time reaches a time on or after a predetermined crank angle.

10. An ignition controller for an internal combustion engine according to claim 6, wherein said predetermined operating state discrimination means includes amount of injected fuel calculation means for calculating an amount of injected fuel based on the drive signal of said injectors, and said predetermined operating state discrimination means discriminates the predetermined operating state when the amount of injected fuel reaches a value equal to or greater than a predetermined value.

11. An ignition controller for an internal combustion engine, comprising:

an angle sensor for detecting a rotational angle of the internal combustion engine;

various sensors for detecting an operating state including a load, of the internal combustion engine;

injectors for injecting fuel to respective cylinders of the internal combustion engine;

ignition coils for imposing a high voltage to ignition plugs of the respective cylinders of the internal combustion engine; and a control and calculation circuit for creating drive signals to said injectors and said ignition coils based on the rotational angle and the operating state, wherein said control and calculation circuit includes:

timing calculation means for calculating the respective timings of said injectors and said ignition coils according to the operating state;

predetermined operating state discriminating means for discriminating a predetermined operating state corresponding to at least one of: a state where fuel adheres to said ignition plugs and a state where fuel is predicted to adhere to said ignition plugs ignition timing switch means for switching the timings at which said ignition coils are driven timings at which said ignition coils are driven according to the predetermined operating state, wherein:

when the predetermined operating state is not discriminated, the timings at which the ignition coils are driven are set to the vicinity of the upper dead point of a compression stroke; and when the predetermined operating state is discriminated, the timings at which the ignition coils are driven are set to the respective vicinities of the upper dead point of the compression stroke and the upper dead point of an exhaust stroke.

* * * * *